US007220158B1

(12) United States Patent
Norris

(10) Patent No.: US 7,220,158 B1
(45) Date of Patent: May 22, 2007

(54) SPORT BOARD CONTACT SYSTEM

(76) Inventor: Bradley Kenneth Norris, P. O. Box 2122, Rancho Santa Fe, CA (US) 92067

( * ) Notice: Subject to any disclaimer, the term of this patent is extended or adjusted under 35 U.S.C. 154(b) by 0 days.

(21) Appl. No.: 11/335,236

(22) Filed: Jan. 18, 2006

(51) Int. Cl.
*B63B 35/81* (2006.01)

(52) U.S. Cl. ..... 441/74; 280/612

(58) Field of Classification Search ..... 441/65, 441/70, 74, 79; 280/14.21, 14.22, 14.24, 280/87.041, 87.042, 607, 612, 613
See application file for complete search history.

(56) References Cited

U.S. PATENT DOCUMENTS 3,437,345 A * 4/1969 Berta ..... 280/607
3,667,771 A * 6/1972 Larson ..... 280/612
4,775,345 A * 10/1988 Gifford ..... 441/75
6,299,192 B1 * 10/2001 Bryce ..... 280/613
6,767,265 B2 * 7/2004 Gamble et al. ..... 441/74
6,863,583 B2 * 3/2005 Takahashi ..... 441/74
2003/0075890 A1 * 4/2003 Jacobs ..... 280/87.042
2003/0211789 A1 * 11/2003 Taylor ..... 441/74
2006/0197311 A1 * 9/2006 Flaig ..... 280/611

* cited by examiner

*Primary Examiner*—Lars A. Olson
(74) *Attorney, Agent, or Firm*—O'Melveny & Myers LLP

(57) ABSTRACT

A contact system for a sport board allows a rider to maintain contact between her feet and the sport board while performing aerial maneuvers. The boarder wears magnetic footwear such as a bootie (for surfing), sheath (for surfing), or shoe (for skateboarding) with an affixed magnet. The board has a contact patch that includes a plate of ferrous metal or another magnet oriented such that it attracts the magnetic footwear. The contact patch is positioned such that it will be stood on by the boarder. During normal boarding and aerial maneuvers, magnetic attractive forces between the footwear and the contact patch will maintain contact between the boarder's feet and the board. However, when the boarder falls, the magnetic attractive forces do not bind the boarder's feet to the board.

13 Claims, 4 Drawing Sheets

SPORT BOARD CONTACT SYSTEM

BACKGROUND OF THE INVENTION

1. Field of the Invention

The present invention relates to sport board accessories and more particularly to devices to maintain contact between a sport board and a rider's feet during spirited maneuvers.

2. Related Art

Riding and controlling a sport board such as a surfboard or skateboard requires that a rider's feet maintain contact and traction with the board. In the case of surfboards, this need for traction is significant as the board, whose upper surface is often constructed of smooth fiberglass, is wet and the rider, at least in warmer water, is often barefoot. Further, aerial maneuvers and stunts, commonly called "aerials," are becoming increasingly popular in board sports. These aerial maneuvers often result in the board leaving the rider's feet in mid-air. In these instances, the board and rider will likely land separately, greatly increasing the risk of injury to the rider through impact with the water or ground, or a collision with the now-uncontrolled board. In the case of surfing, special difficulties are presented as when a surfboard becomes airborne, its large, relatively flat surface is prone to being carried away from the rider by even a slight wind. There is a basic need in board sports, therefore, for devices to aid in rider traction. Further, when a board is used for aerial maneuvers, there is a great need for devices to maintain contact between the airborne board and the rider's feet.

The prior art attempts to solve traction problems do not address the problem of maintaining contact between an airborne board and the rider's feet. The typical traction devices are essentially adhesively-backed Ethyl Vinyl Acetate (EVA) foam sheets. The lower, adhesive surface of the EVA foam sheet is affixed to a location on the surfboard where the rider expects to place a foot. The upper surface of the EVA foam sheet is often textured to provide traction when wet. Many examples of these prior art EVA sheets are commercially available in varying shapes, thicknesses, and configurations. However, when a surfboard becomes airborne, an EVA foam sheet does not address the problem of maintaining contact between the board and the rider's feet. In skateboarding, adhesively-backed "grip tape" is analogous to the EVA foam sheets used in surfing. The lower surface of the grip tape is affixed to a desired location on the skateboard, while the upper surface is textured to provide traction with the rider's feet. This grip tape, however, does not maintain contact with the rider's feet when a skateboarder is performing aerial stunts.

Another example of prior art used to maintain traction with surf boards is surf wax. Surfers often apply a layer of slightly tacky wax to their boards to prevent their feet from slipping on the smooth fiberglass surface of the board. As with the EVA foam sheets, however, this wax layer does not provide sufficient traction to prevent a rider's feet from leaving an airborne board.

There have been prior art attempts to maintain contact between an airborne surfboard and a rider's feet. However, these attempts have introduced other shortcomings that far outweigh any benefit gained by an increased ability to maintain contact. For example, footstraps similar to those used on windsurfing boards have been used in an attempt to maintain contact between the rider's feet and the airborne board. While a windsurfer has a fairly unlimited amount of time to ensure the proper foot positioning on the board before sailing away, a surfer has only seconds to pop-up from paddling in a prone position to a standing position when catching a wave. In this short timeframe, it is exceptionally difficult for the surfer to ensure that one or both feet are properly positioned under the prior art straps on the board. Assuming the surfer is able to position one or both feet under the footstraps, these straps dangerously bind the surfer to the board when the surfer falls or the board hits the beach, submerged rocks or other obstacles. If the surfer falls with one or both feet in the footstraps, the surfboard may capsize, holding the surfer underwater until the surfer can free his feet from the footstraps. Further, as the surfer is falling or when he impacts the surface of the water, he may injure his knees or ankles since his feet are being restrained by the footstraps. Likewise, a skateboarder whose feet are strapped to a skateboard has an increased risk for knee and ankle injuries when falling as the board may contort the skateboarder's legs during a fall. Therefore, there is a need in the art for a system to maintain contact between an airborne board and a rider's feet that allows the rider to stand up on the board quickly and also releases the rider's feet from the board if the rider should fall.

SUMMARY OF THE INVENTION

The present invention addresses the shortcomings of the prior art and provides a contact system for sport boards that allows a rider to maintain contact between her feet and the sport board while performing aerial maneuvers. The present invention utilizes magnetic attractive forces between a magnet and a ferrous metal or another magnet. In a preferred embodiment of the invention, the boarder wears magnetic footwear such as a bootie (for surfing), sheath (for surfing), or shoe (for skateboarding) with an affixed magnet. The board has a contact patch that includes a plate of ferrous metal or another magnet oriented such that it attracts the magnetic footwear. The contact patch is positioned such that it will be stood on by the boarder. During normal boarding and aerial maneuvers, magnetic attractive forces between the footwear and the contact patch will maintain contact between the boarder's feet and the board. However, when the boarder falls, the magnetic attractive forces do not bind the boarder's feet to the board.

DETAILED DESCRIPTION OF A PREFERRED EMBODIMENT OF THE INVENTION

The present invention provides a board contact system that overcomes the limitations of prior-art board contact devices. In the detailed description that follows, like element numerals are used to indicate like elements that appear in one or more of the drawings.

Figure 1A:
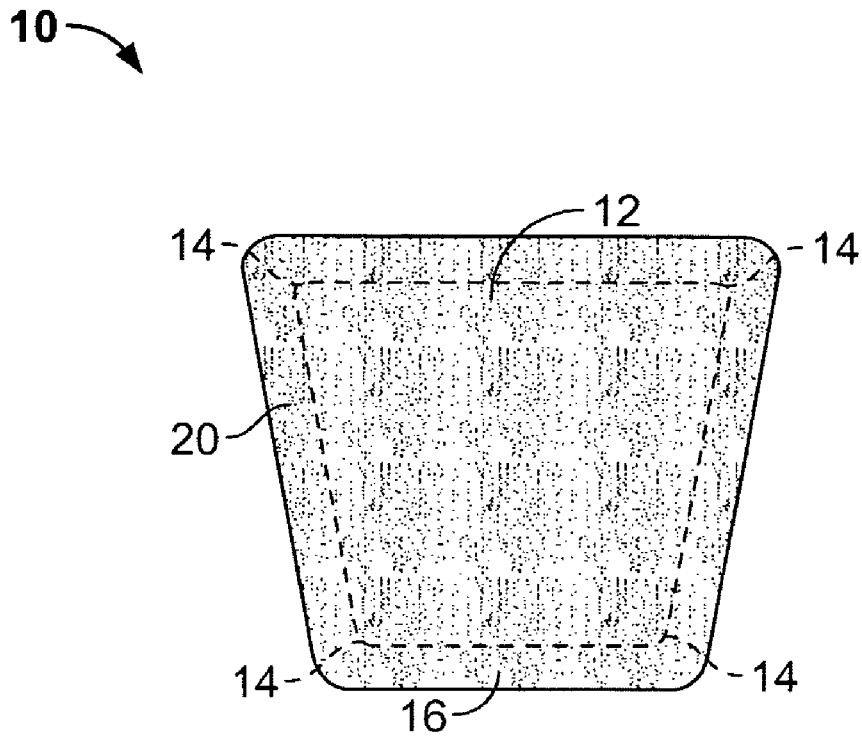
FIGS. 1A and 1B depict a respective top view and a side sectional view of a board contact patch according to an embodiment of the present invention.
Figure 1B:
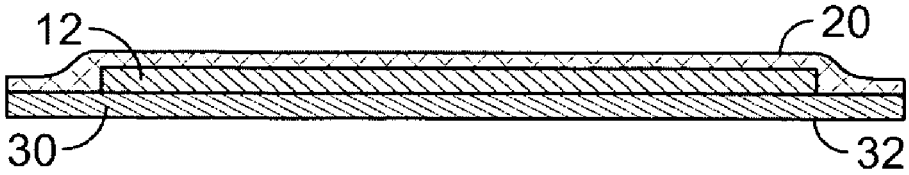

FIG. 1A depicts a top view of a contact patch 10 according to a preferred embodiment of the present invention. FIG. 1B depicts a cross-sectional view of the contact patch depicted in FIG. 1A. The contact patch 10 is of a multilayer construction. In the depicted embodiment, the contact patch 10 comprises three layers. An adhesively backed cushion layer 30 is closest to the board. A metallic layer 12 sits atop the cushion layer 30 and is sandwiched between the cushion layer 30 and a traction layer 20.

The cushion layer 30 has adhesive backing 32 to adhere to a sport board. The cushion layer 30 provides a cushion between the metallic layer 12 and a board (depicted in FIGS. 4 and 5) to which the contact patch 10 will be attached. Thus, the cushion layer 12 allows the contact patch 10 to mold itself to a curved board surface such as a surfboard deck. The cushion layer 30 should be thick enough to allow the contact patch 10 to mold itself to a curved board surface as described, but should not be so thick as to provide a raised obstacle to a boarder. Preferably, the cushion layer is 3 mm thick. Since a primary application for the contact patch 10 of the present invention is on a surf board, the cushion layer 30 material should be water resistant. Preferably, the cushion layer 30 is comprised of a polyolefin foam block adhered to the board using an acrylic pressure sensitive tape with high adhesive mass.

The metallic layer 12 has magnetic properties such that a magnet will be attracted to the metallic layer 12. Ferrous metals tend to have the desired magnetic properties. However, the material used for the metallic layer 12 should also resist corrosion, as a contact patch 10 on a surfboard may be routinely exposed to salt water. Preferably, a stainless steel plate, such as a cold-rolled sheet of grade 410 stainless steel with 2d finish, will be used for the metallic layer 12. Alternately, a magnet (not depicted) could be substituted for the metallic layer 12. The magnet would need to be oriented such that its magnetic poles would attract magnetic footwear (depicted in FIGS. 2 and 3) worn by the boarder. The corners and edges 14 of the metallic layer 12 may be rounded. These rounded corners 14 would reduce the tendency of the traction layer 20 to wear through and expose sharp edges.

The traction layer 20 forms the upper surface of the contact patch. The upper surface of the traction layer 20 should be textured to create traction between the boarder's feet and the board even when the contact patch 10 is wet. The traction layer 20 may be comprised of a textured Ethylene Vinyl Acetate (EVA) foam sheet. Alternately, the traction layer 20 may be an anti-slip sheet designed for marine use such as an aqua-safe anti-slip sheet manufactured by Heskins, Ltd. (information available at www.heskins.com). Since magnetic attractive forces diminish as the distance between the magnetically attracted objects increases, the thickness of the traction layer 20 should preferably be minimized. Therefore, if the traction layer 20 comprises an EVA foam sheet, it is preferably 1 mm thick. The traction layer 20 is adhered to the metallic layer 12 and the cushion layer 30. Preferably, the traction layer 20 is adhered to the metallic layer 12 and the cushion layer 30 with acrylic pressure sensitive tape with high adhesive mass.

Preferably, the surface area of the metallic layer 12 is smaller than each of the surface areas of the cushion layer 30 and the traction layer 20. The metallic layer 12 is positioned such that the edges of the cushion layer 30 and the traction layer 20 extend beyond the edges of the metallic layer 12, creating a substantially uniform border 16 of adhered cushion layer 30 and traction layer 20 material around the metallic layer 12. This uniform border 16 reduces the exposure of the metallic layer 12 to water when the contact patch 10 is used on a surfboard.

Figure 2:
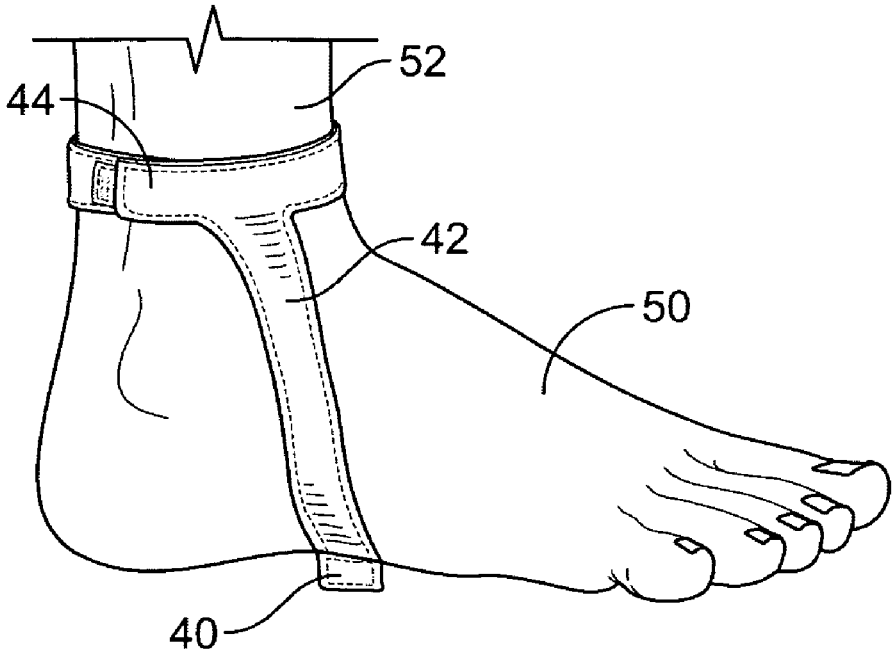
FIG. 2 depicts a side view of a first type of magnetic footwear according to an embodiment of the present invention.
Figure 3:
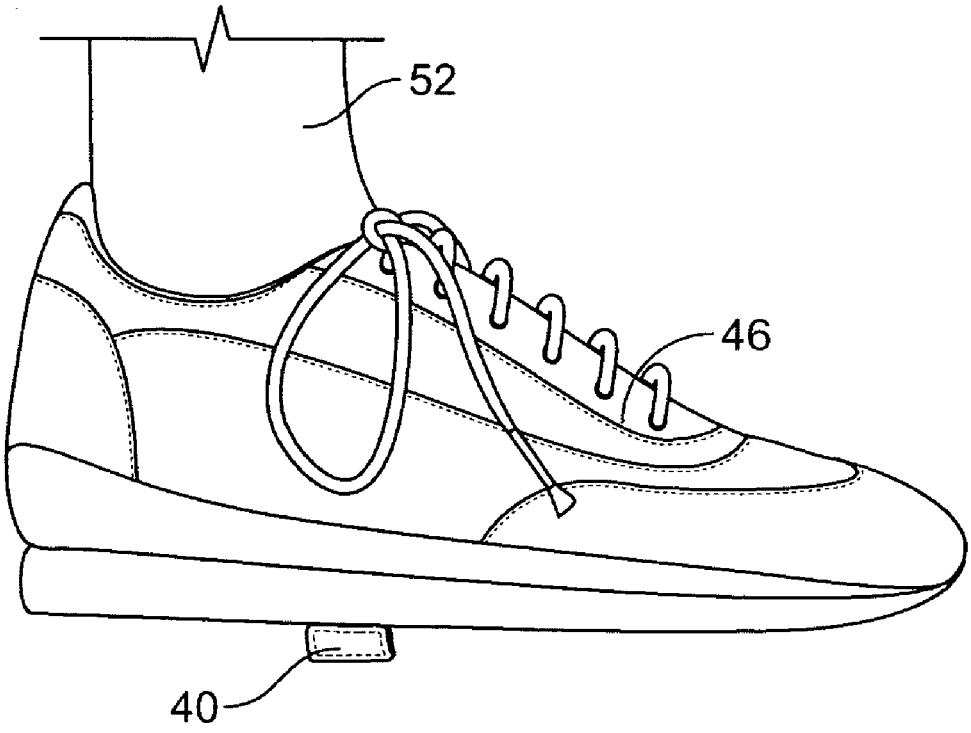
FIG. 3 depicts a side view of a second type of magnetic footwear according to an embodiment of the present invention.

FIGS. 2 and 3 depict two types of magnetic footwear to be worn by a boarder according to the present invention. FIG. 2 depicts a sheath 42 worn on the foot 50 of a surfer. The sheath 42 comprises a band configured to remain on the foot 50 of the surfer. In the depicted embodiment, the band is an ankle strap around the surfer's ankle 52 connected to an underfoot strap. However, other strap configurations are possible and are considered within the scope of the present invention. The sheath 42 is comprised of a material capable of resisting degradation and deterioration when repeatedly immersed in salt water and exposed to direct sunlight. Preferably, the sheath is comprised of neoprene. As depicted, the circumference of the ankle strap can be adjusted with an adjusting strap 44.

Affixed to the underfoot strap is a magnet 40. Many methods of affixing the magnet 40 to the sheath 42 are known in the art. For example, the magnet could be adhered with a chemical adhesive, the magnet could be sewn to the sheath, or the magnet could be bound to the sheath with metal, plastic, or nylon staples. Preferably, the magnet 40 is a rare earth magnet such as a neodymium iron boron (NdFeB) magnet; however, other types of magnets or magnetized pieces of ferrous metals could be used within the scope of the present invention. Preferably, the magnet 40 is a circular disk with a diameter of approximately 1 inch and a thickness of approximately 0.25 inches, although other geometries, such as a rectangular prism, may be used within the scope of the present invention. For surfing in locations with relatively cold water, a bootie (not depicted) may be preferable to a sheath 42. As with the sheath 42, the bootie is comprised of a material capable of resisting degradation and deterioration when repeatedly immersed in salt water and exposed to sunlight. Preferably, the bootie is comprised of neoprene.

FIG. 3 depicts a shoe 46 worn by a skateboarder. A magnet 40 is affixed to the underside of the shoe 46. As noted above with respect to FIG. 2, the magnet 40 may be affixed to the shoe 46 in any of a number of ways known in the art.

Figure 4:
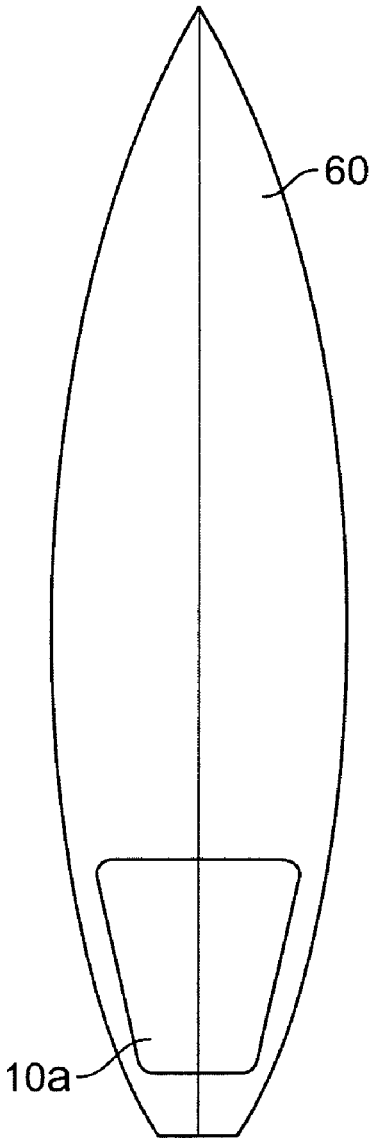
FIG. 4 depicts a top view of a contact patch applied to a surfboard according to an embodiment of the present invention.
Figure 5:
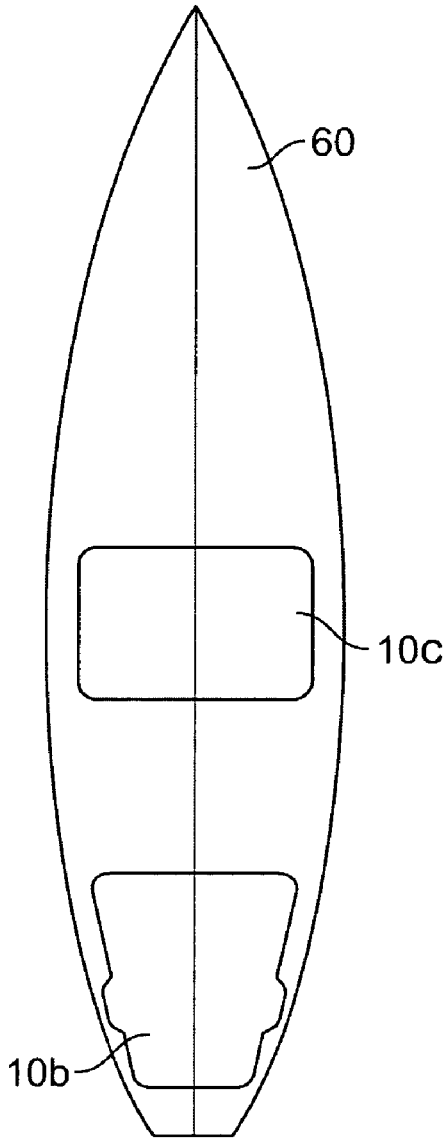
FIG. 5 depicts a top view of a contact patch applied to a surfboard according to an alternative embodiment of the present invention.

FIGS. 4 and 5 depict top views of surfboards 60 with contact patches 10. One or more contact patches 10 may be used in the board contact system of the present invention. In FIG. 4, a single contact patch 10A is adhered to a surf board 60. The contact patch 10A is positioned such that the surfer will stand on it with at least one foot while surfing. The contact patch 10A may be of a shape that conforms to the geometry of the surfboard where the contact patch 10A is positioned. As depicted in FIG. 4, the shape of the contact patch 10A is tapered to match the tapered edges towards the aft end of the surfboard 60. In FIG. 5, two contact patches 10B, 10C are shown adhered to a surfboard 60. The contact patches 10B, 10C are positioned such that the surfer will place one foot on each contact patch 10 while surfing. The contact patches 10B, 10C have shapes corresponding to the geometry of the surfboard where the contact patch 10 is adhered.

Figure 6:
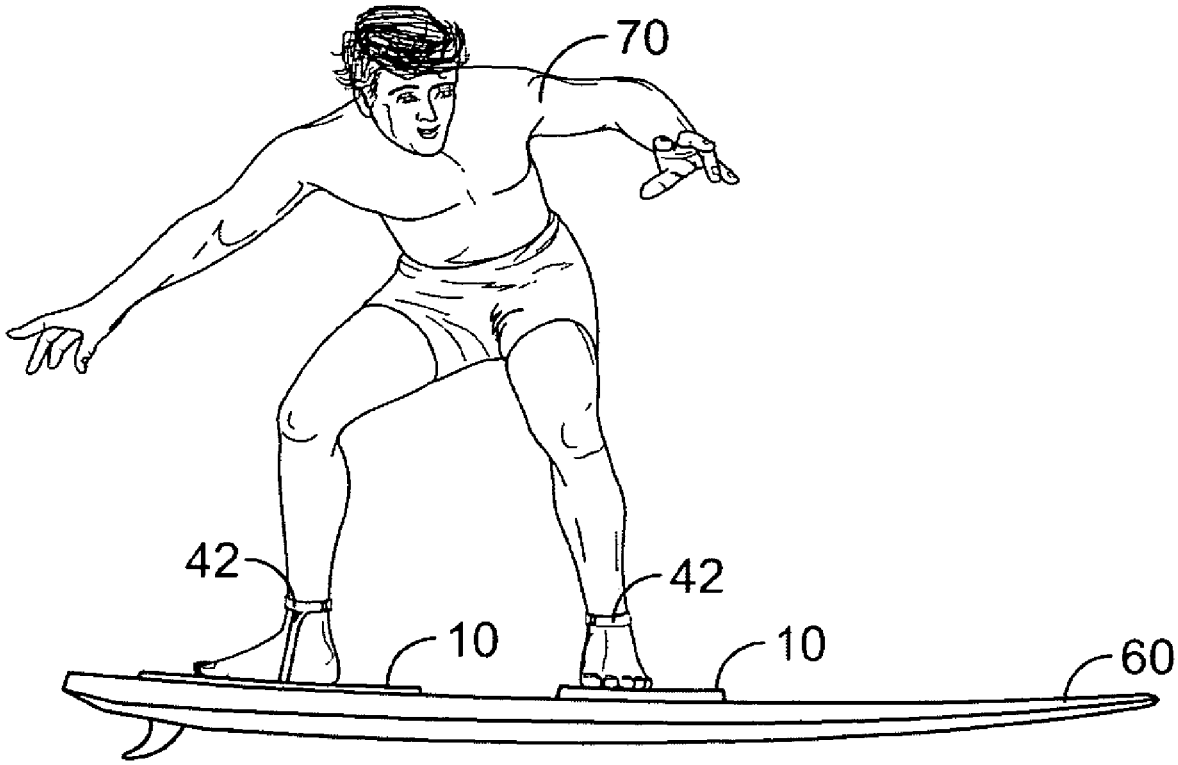
FIG. 6 depicts a side view of a surfer using the system of the present invention.

FIG. 6 depicts a surfer 70 standing on a surfboard 60 using the board contact system of the present invention. The surfer is wearing two sheaths 42 (as depicted in FIG. 2), one on each foot, and the surfboard has two contact patches 10, one for each foot. By using the board contact system of the present invention, the surfer 70 can perform aerial maneuvers with the surfboard 60 and the magnetic attractive forces between the contact patches 10 and the sheaths 42 will maintain contact between the surfer's feet and the surfboard. However, should the surfer 70 fall, his feet are not rigidly bound to the surfboard, greatly reducing the risk of injury to the surfer.

Having thus described several embodiments of the board contact system, it should be apparent to those skilled in the art that certain advantages of the system have been achieved. It should also be appreciated that various modifications, adaptations, and alternative embodiments thereof may be made within the scope and spirit of the present invention. For example, while many of the depictions are addressed to a surfboard embodiment, the board contact system is easily adaptable to skateboard use. Further, while the embodiments feature magnetic footwear and a metallic layer, a system using a magnetic layer and metallic footwear is within the spirit and scope of the present invention. Moreover, while the contact patch of the preferred embodiment of the present invention is a three layer construction. more or fewer layers may be utilized within the spirit and scope of the present invention. The invention is solely defined by the following claims.

What is claimed is:

1. A sport board contact system comprising:

a sport board having an upper deck to accommodate a rider standing thereon;

at least one contact patch affixed to the upper deck of the sport board, the at least one contact patch comprising a first magnetic material; and a footwear adapted to be worn by the rider, the footwear having a first strap adapted to wrap around the rider's ankle and a second strap coupled to the first strap and adapted to extend across a narrow portion of the base of the rider's foot, thereby leaving at least the rider's toes and a substantial portion of the foot base uncovered, the second strap including a contact portion oriented to contact the at least one contact patch during use of the sport board, the contact portion including a second magnetic material;

wherein, the first and second magnetic materials are mutually attractive to maintain contact between the upper deck of the sport board and the contact portion of the footwear.

2. The sport board contact system of claim 1, wherein the sport board further comprises a surf board.

3. The sport board contact system of claim 1, wherein the sport board further comprises a skate board.

4. The sport board contact system of claim 1, wherein the at least one contact patch comprises:

a first layer comprising an adhesive-backed cushion material in contact with the upper deck of the sport board;

a second layer comprising the first magnetic material; and a third layer comprising a traction surface oriented to contact the footwear.

5. The sport board contact system of claim 4, wherein the cushion material further comprises a polyolefin foam block.

6. The sport board contact system of claim 4, wherein the third layer comprises a textured Ethylene Vinyl Acetate (EVA) foam sheet.

7. The sport board contact system of claim 1, wherein the first magnetic material comprises a ferrous metal.

8. The sport board contact system of claim 7, wherein the ferrous metal comprises stainless steel.

9. The sport board contact system of claim 1, wherein the at least one contact patch has a shape conforming to the upper deck of the sport board.

10. The sport board contact system of claim 1, wherein the footwear further comprises a neoprene material.

11. The sport board contact system of claim 1, wherein the second magnetic material comprises a magnet.

12. The sport board contact system of claim 11, wherein the magnet further comprises a rare earth magnet.

13. The sport board contact system of claim 1, wherein the first strap is adjustable.

* * * * *